US006938705B2

(12) United States Patent
Kikuchi

(10) Patent No.: US 6,938,705 B2
(45) Date of Patent: Sep. 6, 2005

(54) STRIKING TOOL

(75) Inventor: Atsuyuki Kikuchi, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/013,349

(22) Filed: Dec. 17, 2004

(65) Prior Publication Data

US 2005/0145403 A1 Jul. 7, 2005

(30) Foreign Application Priority Data

Dec. 18, 2003 (JP) ..... P.2003-420558

(51) Int. Cl.[7] ..... B25D 17/00
(52) U.S. Cl. ..... 173/201; 173/48; 173/210
(58) Field of Search ..... 173/48, 109, 210, 173/212, 201, 128

(56) References Cited

U.S. PATENT DOCUMENTS 4,113,035 A * 9/1978 Stiltz et al. ..... 173/201
4,442,906 A * 4/1984 Simpson ..... 173/48
4,750,567 A * 6/1988 Grossmann et al. ..... 173/13
5,775,440 A * 7/1998 Shinma ..... 173/109
5,873,418 A * 2/1999 Arakawa et al. ..... 173/212
6,035,945 A * 3/2000 Ichijyou et al. ..... 173/48
6,484,814 B2 * 11/2002 Bongers-Ambrosius ..... 173/2
6,568,484 B1 * 5/2003 Schmid et al. ..... 173/201
6,644,418 B2 * 11/2003 Haga ..... 173/48
6,675,908 B1 * 1/2004 Frauhammer et al. ..... 173/48
6,763,897 B2 * 7/2004 Hanke et al. ..... 173/210

FOREIGN PATENT DOCUMENTS

JP 2003-300180 10/2003

* cited by examiner

*Primary Examiner*—Scott A. Smith
(74) *Attorney, Agent, or Firm*—McGinn & Gibb, PLLC

(57) ABSTRACT

A projected portion provided at a cylinder and projected in a radius direction is formed at an end face thereof on a side of a tool holding portion, and a holding portion on one side of holding portions for holding an outer periphery of the cylinder by at least two portions remote from each other in an axial direction to position in the radius direction of the cylinder is configured by a guide face having an inner diameter of a dimension substantially the same as an outer diameter of the projected portion and extended over to a contact face brought into contact with the projected portion from an end face of a cylinder case on a side of the tool holding portion.

6 Claims, 5 Drawing Sheets

STRIKING TOOL

BACKGROUND OF THE INVENTION

1. Field of the Invention

The present invention relates to a striking tool such as a hammer, a hammer drill which is configured to position a cylinder at inside of a cylinder case.

2. Description of the Related Art

A striking tool of a related art will be explained in reference to FIG. 6 through FIG. 8.

As shown by the drawings, a striking tool of a related art is configured by a structure including a motor 1, a cylinder 2, a cylinder case 3 covering an outer periphery of the cylinder 2, a tool holding portion 5 capable of holding a front end tool 4, a piston 6 capable of reciprocating at inside of the cylinder 2, a striker 8 reciprocating at inside of the cylinder 2 by being exerted with a reciprocating force of the piston 6 via an air chamber 7, a breathing hole 9 provided at the outer periphery of the cylinder 2 and communicatable with the air chamber 7, a crankshaft 11 exerted with a rotational force of the motor 1 via a reduction gear 10 and converting the rotational force into the reciprocating force to transmit to the piston 6 via a connecting rod 12, a middle piece 13 struck by the striker 8 and capable of transmitting a strike force thereof to the front end tool 4, a slide sleeve 15 provided on the outer periphery of the cylinder 2, urged to a side of the middle piece by a spring 14, and capable of opening and closing an outer periphery of the breathing hole 9 in accordance with a moving position thereof, a cylinder holder 16 brought into contact to be fitted with an end face of the cylinder 2 on a side of the tool holding portion and having three foot portions 16*a* (FIG. 7), a first hammer holder 17 an end portion of which is brought into contact with an end portion of the slider sleeve 15 and which includes three foot portions 17*a* arranged among the respective foot portion 16*a* of the cylinder holder 16, a second hammer holder 18 an outer periphery of which is held by the first hammer holder 17 and capable of being brought into contact with a portion of the middle piece 13 opposed thereto, and a buffer member 19 arranged between the first hammer holder 17 and the second hammer holder 18 in which the cylinder 2 is provided with a flange portion 2*a* projected in a radius direction on a side of the motor 1, and the cylinder case 3 is provided with a butting face 3*a* capable of being brought into contact with the flange portion 2*a* and a first holding portion 3*b* brought into contact with the outer periphery of the cylinder 2 on a side of the motor 1 to position in a radius direction.

As shown by FIG. 8, an inner diameter dimension of the first holding portion 3*b* is formed to be a dimension substantially the same as an outer diameter dimension of the cylinder 2 and in this way, a vicinity of the end portion of the cylinder 2 on the side of the motor 1 is positioned in the radius direction by the first holding portion 3*b*.

Further, positioning of the cylinder 2 in the radius direction on a side of the tool holding portion 5 is carried out by bringing a second holding portion 3*c* having an inner diameter of a dimension substantially the same as an outer diameter dimension of the cylinder holder 16 into contact with the cylinder holder 16. (refer to, for example, JP-A-2003-300180).

SUMMARY OF THE INVENTION

According to the striking tool of the above-described related art, although the cylinder 2 is integrated into the cylinder case 3 from the side of the tool holding portion 5, in integrating the cylinder 2 to the cylinder case 3, when the cylinder 2 is inclined or an axis center of the cylinder 2 and the axis center of the first holding portion 3*b* do not coincide with each other, an outer peripheral portion of the cylinder 2 on the side of the motor 1 cannot be inserted to fit with the first holding portion 3*b* and integrating performance is poor.

Particularly, when there is configured by an idle striking preventing mechanism for preventing continuous reciprocating movement of the striker 8 at no load time, since the slide sleeve 15, the spring 14 and the like are provided on the outer periphery of the cylinder 2, there is needed a space between the outer periphery of the cylinder 2 and the cylinder case 3 at a vicinity of substantially a center of the cylinder 2, in integrating the cylinder 2, the cylinder 2 is liable to incline and the integrating performance is poor.

When diameter dimensions of the holding portions 3*b*, 3*c* are larger than the outer periphery of the cylinder 2 by putting emphasis on the integrating performance, there is a concern of rattling the cylinder 2 in the radius direction at inside of the cylinder case 3 to effect influence on the striking force and produce life.

Further, in striking, a face portion 17*b* of the first hammer holder 17 on a side of the slide sleeve 15 is repeatedly brought into contact with a contact face 16*b* of the cylinder holder 16 made of a resin on the side of the tool holding portion 5 and therefore, there is a case of deforming the cylinder holder 16 or the like.

It is an object of the invention to provide a striking tool eliminating the above-described drawbacks of the related art and having excellent integrating performance.

Further, it is an object of the invention to provide a striking tool having excellent integrating performance even in a constitution of having an idle striking preventing mechanism.

According to first aspect of the invention, the projected portion of the cylinder is formed at an end face thereof on the side of the tool holding portion. A holding portion positions the cylinder in the radius direction thereof by holding the outer periphery of the cylinder by two separated portions from each other in an axial direction thereof. The holding portion on the one side is configured by a guide face which has an inner diameter of a dimension substantially the same as an outer diameter of the projected portion and which is extended from the end face of the tool holding portion side on the cylinder case over to the contact face of the cylinder.

By thus configuration, the striking tool can be promoted and the striking piece having excellent integrating performance can be provided.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Figure 1:
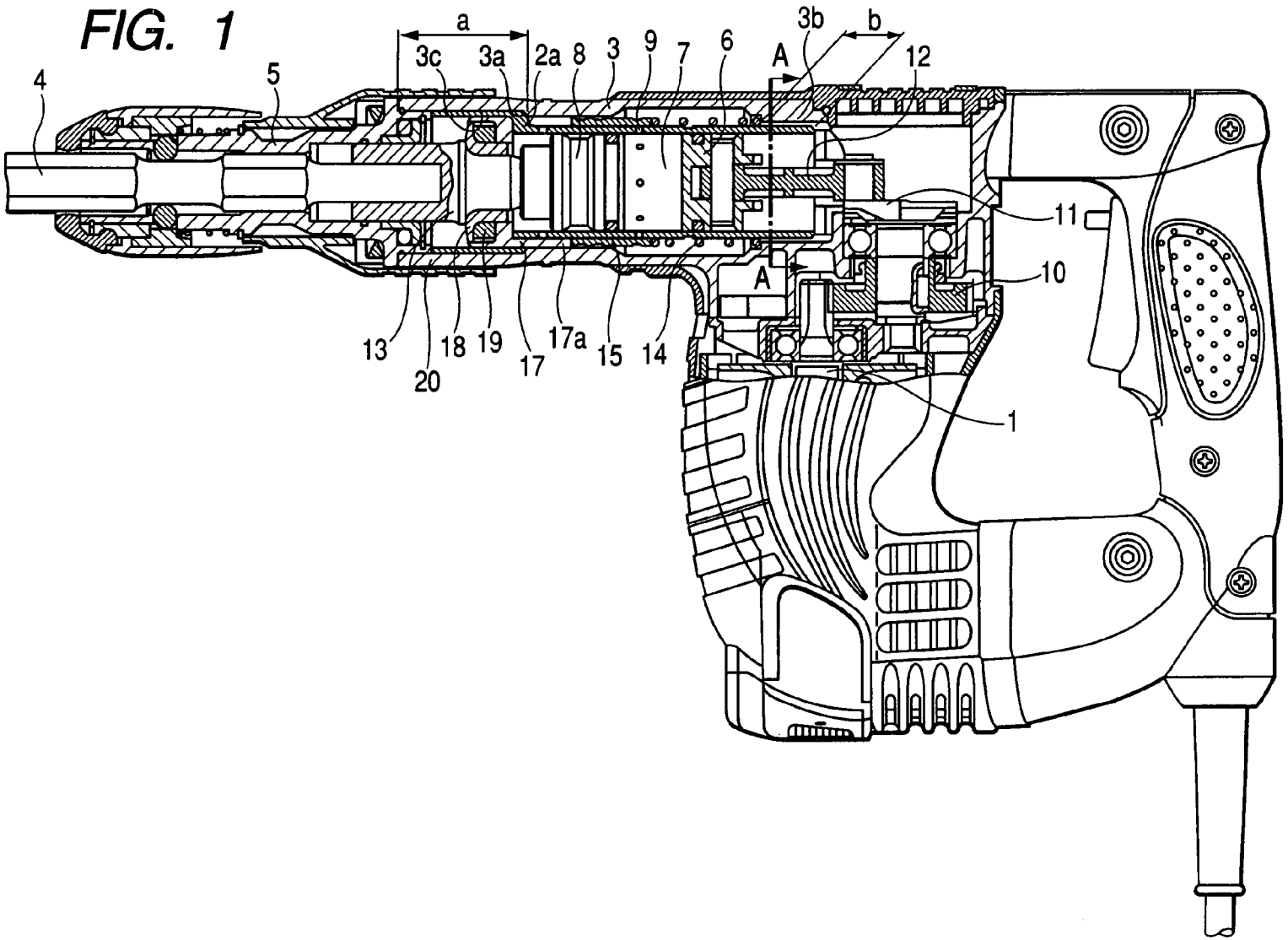
FIG. 1 is a vertical front sectional view showing an embodiment of a striking tool according to the invention.

An embodiment of a striking tool according to the invention will be explained in reference to FIG. 1 through FIG. 5 as follows.

As shown by the drawings, a striking tool according to one embodiment of the invention is configured by the motor 1, the cylinder 2, the cylinder case 3 covering the outer periphery of the cylinder 2, the tool holding portion 5 capable of holding the front end tool 4, the piston 6 capable of reciprocating at inside of the cylinder 2, the striker 8 exerted with the reciprocating force of the cylinder 6 via the air chamber 7 and reciprocating at inside of the cylinder 2, the breathing hole 9 provided at the outer periphery of the cylinder 2 and communicatable with the air chamber 7, the crankshaft 11 which is a movement converting member exerted with the rotational force of the motor 1 via the reduction gear 10 and converting the rotational force into the reciprocating force to transmit to the piston 6 via the connecting rod 12, the middle piece 13 struck by the striker 8 and capable of transmitting the striking force to the front end tool 4, the slider sleeve 15 provided on the outer periphery of the cylinder 2, urged to the side of the middle piece 13 by the spring 14 and capable of opening and closing the outer periphery of the breathing hole 9 in accordance with the moving position, the first hammer holder 17 the end portion of which is brought into contact with the end portion of the slider sleeve 15 at the outer periphery of the cylinder 2 and having the three foot portions 17*a*, the hammer holder 18 the outer periphery of which is held by the first hammer holder 17 and capable of being brought into contact with the projected portion of the middle piece 13, and the buffer member 19 arranged between the first hammer holder 17 and the second hammer holder 18.

Operation of the striking tool according to the invention will be explained.

When the front end tool 4 is brought into a state of being moved to a side of the striker 8 by pressing a front end of the front end tool 4 to a member to be struck, the middle piece 13 is moved to the side of the striker 8 along with the front end tool 4, and a moving force of the middle piece 13 is transmitted to the side sleeve 15 via the second hammer holder 18, the buffer member 19 and the first hammer holder 17 which configures cooperatively moving members to move the slide sleeve 15 in a right direction of the illustration against an urging force of the spring 14 which configures urging member. By moving the slide sleeve 15, the breathing hole 9 provided at the outer periphery of the cylinder 2 communicatably with the air chamber 7 is closed by the slide sleeve 15.

When the motor 1 is driven in the state of moving the front end tool 4 to the side of the striker 8 and closing the breathing hole 9 in this way, the rotational force of the motor 1 rotates the crankshaft 11 via the reduction gear 10 to be converted into reciprocating movement of the piston 6 by the connecting rod 12 connected to the crankshaft 11. A pressure of the air chamber 7 is varied by the reciprocating movement of the piston 6, the striker 8 is moved to strike the middle piece 13 and the front end tool 4 held at inside of the tool holding portion 5 is struck by the middle piece 13. When the breathing hole 9 is closed and the motor 1 is continued to be driven, striking operation of the front end tool 4 is continuously carried out.

Next, when a load of the front end tool 4 for pressing the member to be struck is released, or when the front end tool 4 is moved to a position remote from the striker 8, the side sleeve 15, the cooperatively moving members and the middle piece 13 are moved to the side of the tool holding portion 5 by the urging force of the spring 14. When the breathing hole 9 is opened by releasing the breathing hole 9 from being closed by the slide sleeve 15 by the movement, the air chamber 7 between the piston 6 and the striker 8 is opened and therefore, even when the piston 6 is reciprocated by the rotational force of the motor 1, the striker 8 is not reciprocated by following reciprocal movement of the piston 6, or reciprocating energy is reduced and therefore, the middle piece 13 is released from being struck, as a result, the striking force is not transmitted to the front end tool 4. The front end tool 4 is prevented from being struck in no load time in this way.

Next, an explanation will be given of detailed constitutions of the cylinder 2 and the cylinder case 3 and a structure of positioning in a radius direction of the cylinder 2 at inside of the cylinder case 3.

The cylinder 2 is integrated to the cylinder case 3 from the side of the tool holding portion 5.

A flange portion 2*a* including a projected portion projected in the radius direction is provided at an end portion of the cylinder 2 on the side of the tool holding portion 5.

Figure 2:
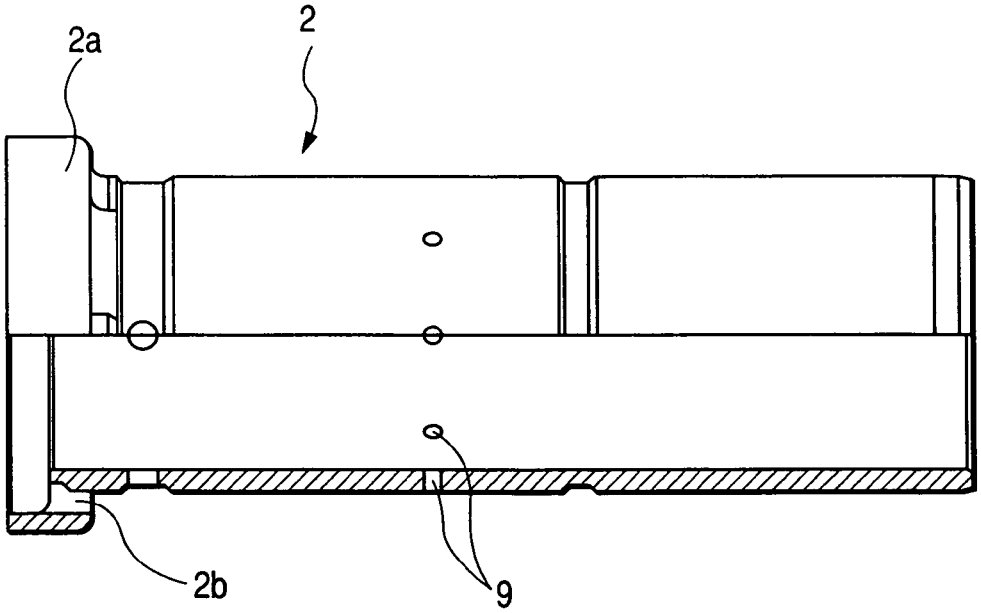
FIG. 2 is a front view showing an embodiment of a cylinder in the striking tool of the invention.
Figure 3:
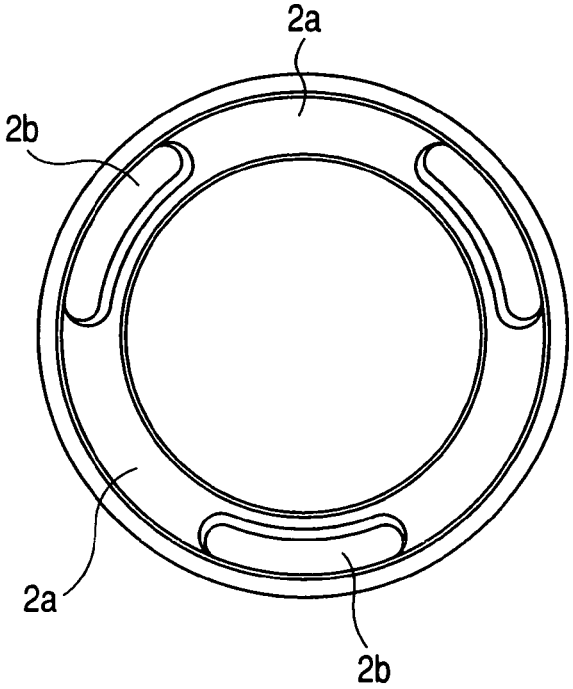
FIG. 3 is a side view showing the embodiment of the cylinder in the striking tool of the invention.
Figure 4:
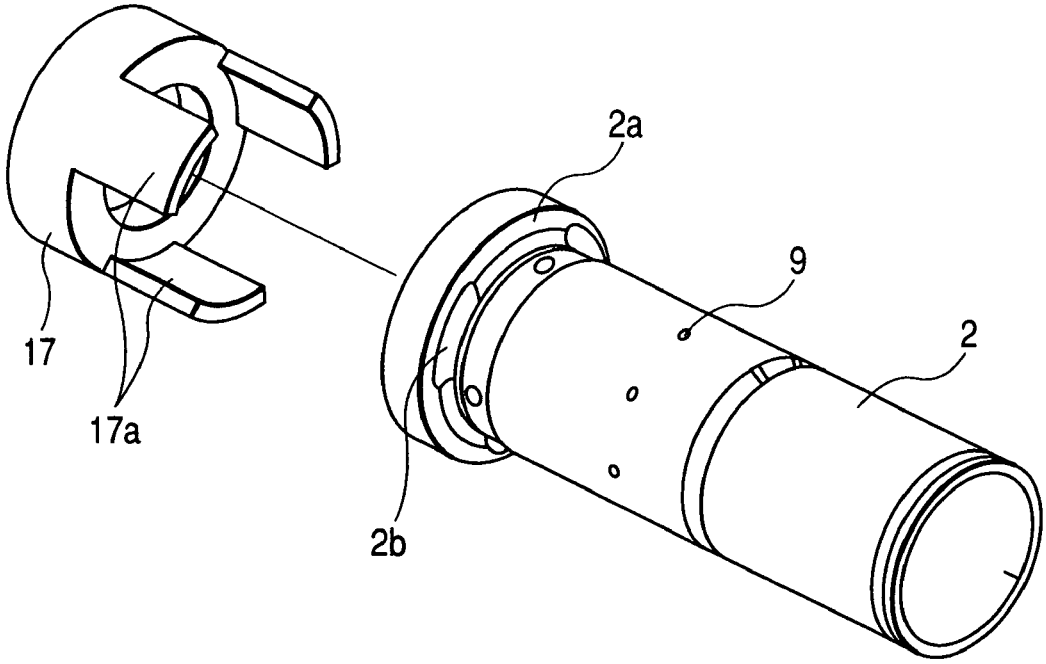
FIG. 4 is a disassembled perspective view showing the embodiment of the cylinder and a first hammer holder in the striking tool of the invention.

As shown by FIG. 2, a section of the flange portion 2*a* is formed by a stepped shape and is configured to be formed with three hole portions 2*b* in the radius direction as shown by FIG. 2 and FIG. 3. The hole portion 2*b* is provided within a range in which the end portion of the side sleeve 15 is disposed in the radius direction.

As shown by FIG. 1, the cylinder case 3 is configured by holding portions 3*b*, 3*c* for positioning the cylinder 2 in the radius direction at positions thereof remote from each other.

The holding portion 3*b* on one side holds an outer periphery of a vicinity of an end portion of the cylinder 2 on the side of the motor 1 and the holding portion 3*b* on other side holds an outer periphery of a vicinity of an end portion of the cylinder 2 on the side of the tool holding portion 5.

Figure 5:
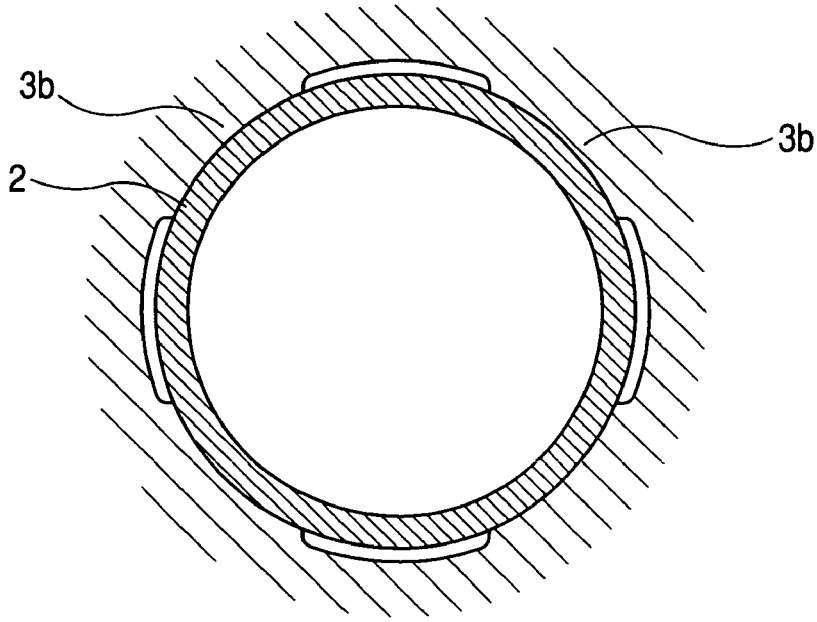
FIG. 5 is a sectional view enlarging an essential portion taken along a line A—A of FIG. 1.
Figure 6:
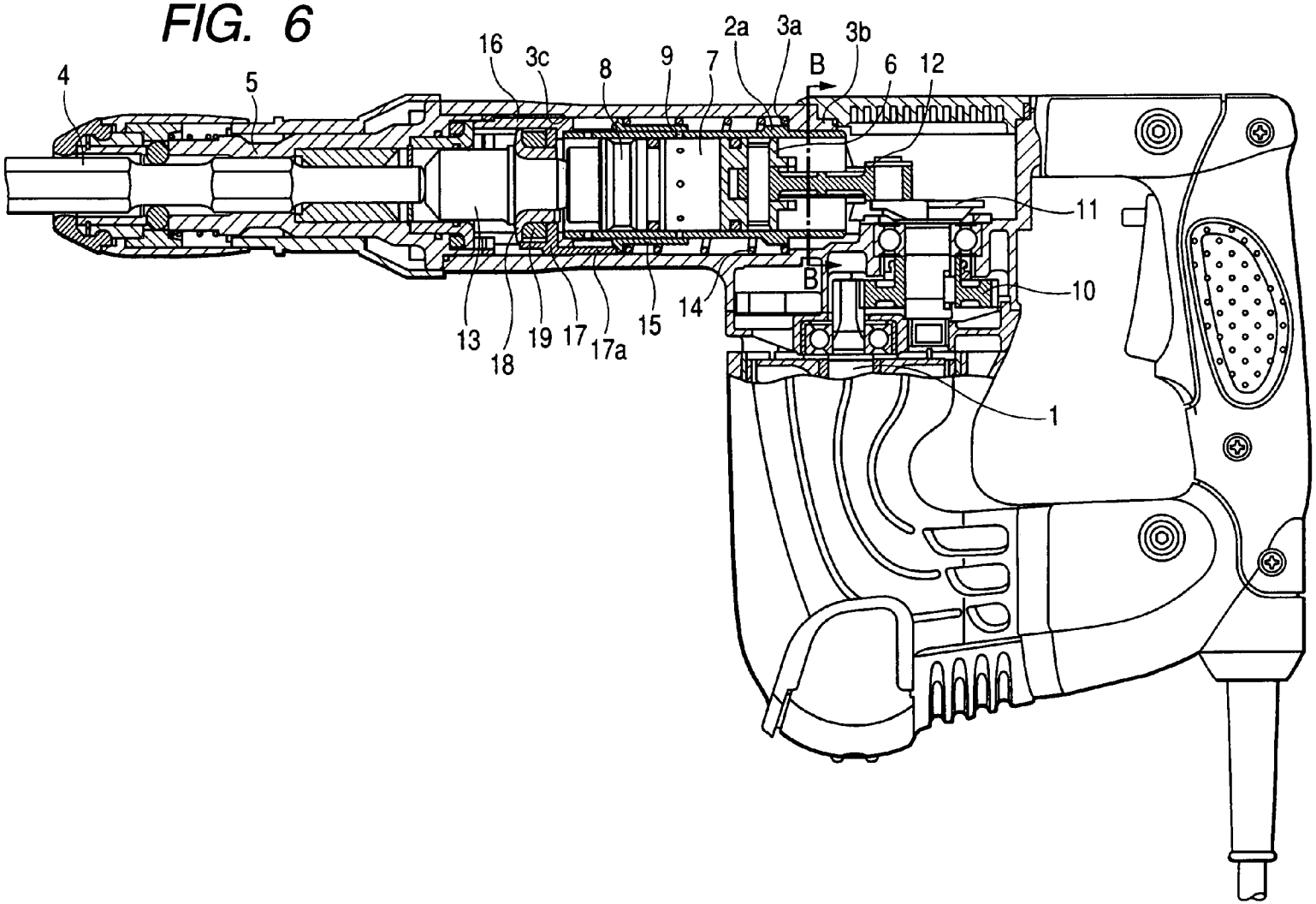
PRIOR ART FIG. 6
FIG. 6 is a vertical front sectional view showing an example of a striking tool of a related art.
Figure 7:
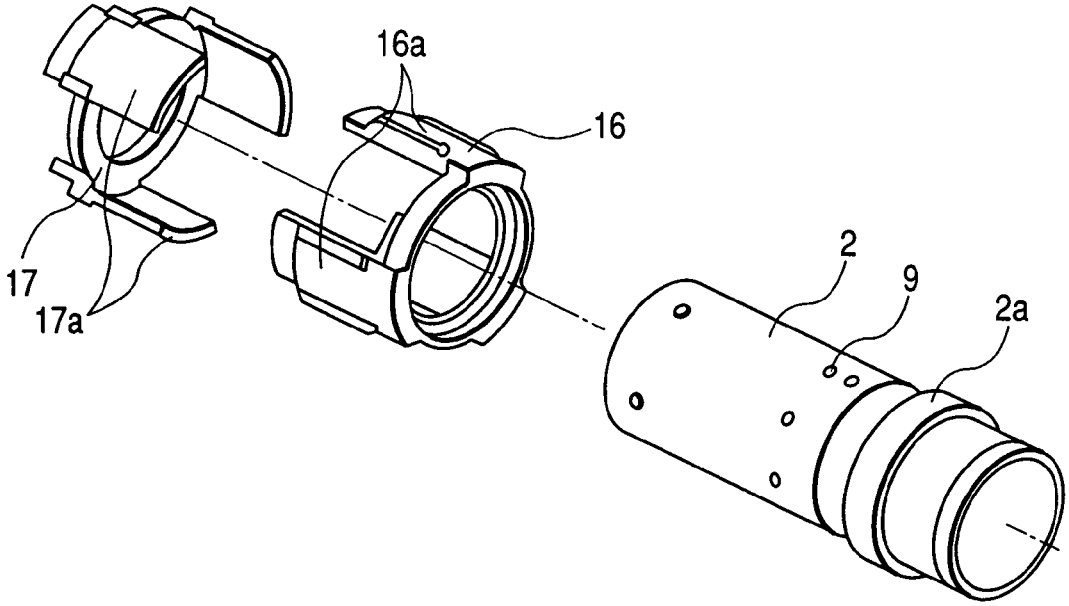
PRIOR ART FIG. 7
FIG. 7 is a disassembled perspective view showing an example of a cylinder, a cylinder holder and a first hammer holder of the striking tool of the related art.
Figure 8:
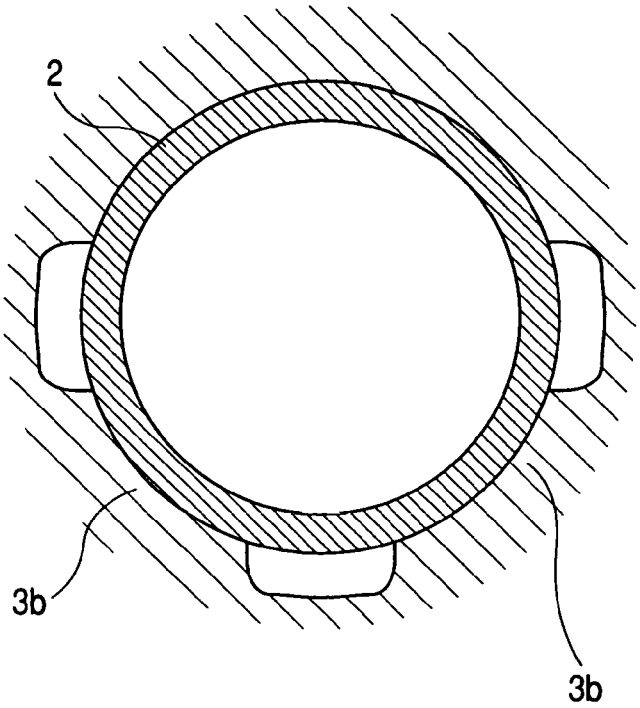
PRIOR ART FIG. 8
FIG. 8 is a sectional view taken along a line B—B of FIG. 6.

As shown by FIG. 5, the holding portion 3*b* is configured by 4 pieces of projected portions 3*b* having an inner diameter dimension of a dimension substantially the same (or more or less smaller than) the outer diameter dimension of the outer periphery of the vicinity of the end portion of the cylinder 2 on the side of the motor 1, and air paths are formed among the projected portions 3*b*. The air paths are formed with an object of communicating a space on the side of the crankshaft 11 and a space on the side of the outer periphery of the cylinder 2.

A guide face 3*c* which configures a holding portion 3*c* is formed to extend from the end face of the cylinder 2 on the side of the tool holding portion 5 to the contact face 3*a* capable of being brought into contact with the projected portion 2*a*, and the guide face 3*c* is configured by a shape having an inner diameter of a dimension substantially the same as (or more or less smaller than) the outer diameter dimension of the projected portion 2*a*.

A length a in an axial direction of the guide face 3*c* is longer than a length b in the axial direction for bringing the projected portion 3*b* into contact with the outer periphery of the cylinder 2, that is, the length a and the length b are configured to satisfy a relationship of a>b.

Positioning in the radius direction of the cylinder 2 is carried out at inside of the cylinder case 3 by the holding portions 3*b*, 3*c* remote from each other in the axial direction in this way to prevent the cylinder 2 from being rattled or the like.

By bringing the projected portion 2*a* of the cylinder 2 into contact with the contact face 3*a* of the cylinder case 3, drawout prevention and positioning of the cylinder 2 to the side of the motor 1 are carried out. Drawout prevention and positioning of the cylinder 2 to the side of the tool holding portion 5 are carried out by being brought into contact with a sleeve 20 arranged between an end portion of the cylinder 2 and an end portion of the tool holding portion.

As described above, by the projected portion 2*a* projected in the radius direction at the end face of the cylinder 2 on the side of the tool holding portion 5, operability in integrating the cylinder 2 to the cylinder case 3 can be promoted.

This is because by observing and grasping a relationship between the holding portion 3*c* (guide face 3*c*) on one side disposed at the end portion on the side of the tool holding portion 5 which configures a front side of integration and the projected portion 2*a* of the cylinder 2, also a relationship between the holding portion 3*b* (projected portion 3*b*) on other side disposed on a depth side of integration and the outer periphery of the cylinder 2 can be grasped, specifically, by integrating to make the axis centers of the guide face 3*c* and the projected portion 2*c* coincide with each other, the axis centers of the projected portion 2*b* and the outer periphery of the cylinder 2 can naturally be made to coincide with each other and integrating operation can easily be carried out.

Further, by the relationship that the length a in the axial direction of the guide face 3*c* is longer than the length b in the axial direction of bringing the projected portion 3*b* into contact the outer periphery of the cylinder 2 as described above, when the projected portion 2*a* is slid to the side of the motor 1 in a state of bringing the projected portion 2*a* into contact with the guide face 3*c*, integration can be carried out in a state of making the axis centers of the projected portion 3*b* and the outer periphery of the cylinder 2 coincide with each other naturally and integrating performance can further by promoted.

Further, although according to the striking tool of the related art, the projected portion 3*b* is configured to include a contact face of being brought into contact with a flange portion 2*a* and therefore, it is necessary to form a diameter of air paths provided among the projected portions 3*b* longer than that of the projected portion 3*b* in order to ensure flow path areas of the air paths to thereby hamper small-sized formation of the tool diameter, the air path can be configured by a minimum size and small-sized formation of the tool diameter can be achieved.

Further, although according to the striking tool of the related art, positioning in the radius direction of the cylinder 2 on the side of the tool holding portion 5 is carried out via the cylinder holder 16 provided between the cylinder 2 and the cylinder case 3, and dimensional accuracy of the cylinder holder 16 effects an influence on positioning in the radius direction of the cylinder 2, according to the invention, the cylinder 2 is configured to be positioned by being brought into direct contact with the cylinder case 3 and therefore, positioning accuracy can more be promoted than that of the related art.

Further, by the projected portion 2*a* at the end face of the cylinder 2, the first hammer holder 17 which configures the cooperatively moving member can be configured to be brought into direct contact with the end face of the cylinder 2 on the side of the tool holding portion 5 and therefore, an outer peripheral portion of the buffer member 19 can be configured by a circular shape, and sliding performance of the first hammer holder can be restrained from being deteriorated.

Numeral 1 designates a motor, numeral 2 designates a cylinder, notation 2*a* designates a projected portion (flange portion), notation 2*b* designates a hole portion, numeral 3 designates a cylinder case, notation 3*a* designates a contact face, notation 3*b* designates a projected portion (holding portion), notation 3*c* designates a guide face (holding portion), numeral 4 designates a front end tool, numeral 5 designates a tool holding portion, numeral 6 designates a piston, numeral 7 designates an air chamber, numeral 8 designates a striker, numeral 9 designates a breathing hole, numeral 10 designates a reduction gear, numeral 11 designates a crankshaft, numeral 12 designates a connecting rod, numeral 13 designates a middle piece, numeral 14 designates a spring, numeral 15 designates a slide sleeve, numeral 16 designates a first hammer holder, notation 17*a* designates a foot portion, numeral 18 designates a second hammer holder, notation 18*a* designates a foot portion, numeral 19 designates a buffer member, and numeral 20 designates a sleeve.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A striking tool comprising:

a motor;

a tool holding portion capable of holding a front end tool;

a cylinder covered with a cylinder case including a contact face opposed to a side of the tool holding portion at an outer periphery thereof where a breathing hole communicable with an air chamber is provided;

a piston capable of reciprocating in the cylinder;

a striker reciprocating in the cylinder by being exerted with a reciprocating force of the piston via an air chamber;

a movement converting member exerted with a rotational force of the motor via a reduction gear and converting the rotational force into the reciprocating force to transmit to the piston;

a middle piece struck by the striker and capable of transmitting a striking force of the striker to the front end tool;

a projection portion projecting in a radius direction of the cylinder and capable of being brought into contact with the contact face of the cylinder case; and a holding portion which positions the cylinder in the radius direction thereof by holding the outer periphery of the cylinder by at least two separated portions from each other in an axial direction thereof, wherein the projected portion of the cylinder is formed at an end face thereof on the side of the tool holding portion, the holding portion on the one side is configured by a guide face which has an inner diameter of a dimension substantially the same as an outer diameter of the projected portion, and the guide face is extended from the end face of the tool holding portion side on the cylinder case over to the contact face of the cylinder case.

2. The striking tool according to claim 1, wherein a length in the axial direction of the guide face is made to be longer than a length in the axial direction of holding the outer periphery of the cylinder by the holding portion on the other side.

3. The striking tool according to claim 1, further including;

a slide sleeve urged to a side of the middle piece by urging member on the outer periphery of the cylinder and capable of opening and closing an outer periphery of the breathing hole in accordance with a moving position thereof; and a cooperatively moving member the one end of which is capable of being brought into contact with an end portion of the slide sleeve on a side of the tool holding portion and the other end of which is capable of being brought into contact with an opposed portion of the middle piece opposed to a side of the striker, wherein a plurality of the projected portions are provided, and the cooperatively moving member includes a foot portion interposed between the projected portions.

4. The striking tool according to claim 3, wherein the cooperatively moving member includes;

a first hammer holder including a plurality of the foot portions;

a second hammer holder an outer periphery of which is held by the first hammer holder and which is capable of being brought into contact with the opposed portion of the middle piece, and a buffer member arranged between the first hammer holder and the second hammer holder.

5. The striking piece according to claim 1, wherein the projected portion is formed by providing a plurality of hole portions at a flange portion projected in the radius direction.

6. The striking tool according to claim 4, wherein the first hammer holder includes a circular portion covering the buffer member.

* * * * *